US006467859B2

(12) United States Patent
Branz et al.

(10) Patent No.: US 6,467,859 B2
(45) Date of Patent: Oct. 22, 2002

(54) ENVIRONMENTALLY CONTROLLED CABINET WITH SLIDING DOOR WITHIN HINGED DOOR

(75) Inventors: Michael A. Branz, Spartanburg; Hing Wah Chiu, Greer, both of SC (US)

(73) Assignee: Specialty Equipment Companies, Inc., Aurora, IL (US)

( * ) Notice: Subject to any disclaimer, the term of this patent is extended or adjusted under 35 U.S.C. 154(b) by 0 days.

(21) Appl. No.: 09/731,576

(22) Filed: Dec. 7, 2000

(65) Prior Publication Data

US 2001/0030492 A1 Oct. 18, 2001

Related U.S. Application Data

(60) Provisional application No. 60/169,586, filed on Dec. 8, 1999.

(51) Int. Cl.[7] ..... A47B 81/00; A47F 3/00

(52) U.S. Cl. ..... 312/292; 312/139.2

(58) Field of Search ..... 312/236, 400, 312/401, 402, 404, 405, 407, 407.1, 291, 292, 116, 139.2

(56) References Cited

U.S. PATENT DOCUMENTS

| | | | | |
|---|---|---|---|---|
| 1,607,922 A | | 11/1926 | Schweitzer | |
| 2,163,562 A | | 6/1939 | Putnam et al. | |
| 2,438,972 A | | 4/1948 | Hoffman | |
| 2,793,925 A | * | 5/1957 | Rosen | 312/139.2 |
| 2,816,318 A | | 12/1957 | Philipp | |
| 2,873,161 A | * | 2/1959 | Lambert et al. | 312/292 |
| 3,851,939 A | * | 12/1974 | Benasutti et al. | 312/139.2 |
| 4,046,438 A | * | 9/1977 | Benasutti et al. | 312/139.2 |
| 4,072,486 A | | 2/1978 | Joseph | |
| 4,130,326 A | * | 12/1978 | Hornblad | 312/292 |
| 5,136,492 A | | 8/1992 | Rush | |
| 5,301,092 A | | 4/1994 | Santosousso et al. | |
| 5,471,372 A | | 11/1995 | Mamelson et al. | |
| 5,699,676 A | | 12/1997 | Trulaske, Sr. | |
| 5,879,070 A | | 3/1999 | Severloh | |
| 5,937,666 A | | 8/1999 | Trulaske, Sr. | |
| 6,171,173 B1 | * | 1/2001 | Alcala et al. | 312/204 X |
| 6,241,328 B1 | * | 6/2001 | Ziff | 312/292 X |

FOREIGN PATENT DOCUMENTS

| | | | |
|---|---|---|---|
| FR | 940265 | * 12/1948 | 312/292 |
| FR | 1022560 | 3/1953 | |

* cited by examiner

*Primary Examiner*—James O. Hansen

(57) ABSTRACT

A temperature and/or humidity controlled cabinet includes an environmentally controlled compartment having a main access opening and a swing door that is configured to selectively permit access to the inside of the environmentally controlled compartment via at least a portion of the main access opening and to close off access to the inside of the temperature controlled compartment via at least a portion of the main access opening. The cabinet further includes at least one sliding door that is defined in a portion of the swing door and that is configured to selectively permit access to the inside of the environmentally controlled compartment and to close off access to the inside of the environmentally controlled compartment.

6 Claims, 4 Drawing Sheets

ENVIRONMENTALLY CONTROLLED CABINET WITH SLIDING DOOR WITHIN HINGED DOOR

RELATED APPLICATIONS

The present application is a continuation application to provisional application Serial No. 60/169,586 filed Dec. 8, 1999.

BACKGROUND OF THE INVENTION

The present invention relates to cabinets in which the environment inside the cabinet is controlled and more particularly to refrigerated cabinets and warming cabinets with swing door access to the temperature and/or humidity controlled compartment(s).

In a commercial setting, foodstuffs and/or other products that require controlled environments insofar as the temperature and/or humidity is concerned, are periodically being withdrawn from the environmentally controlled compartment of a cabinet such as a refrigerated cabinet or a warming cabinet. Accordingly, the stored contents of these temperature and/or humidity controlled compartments periodically are replenished. The most convenient and efficient way to effect such replenishment is typically via a large swing door. However, individual portions of the stored contents are being retrieved from storage numerous times during the course of the day and over much shorter intervals than the time periods that elapse between restocking of the environmentally controlled storage compartment. Opening such a large swing door to retrieve individual portions of the stored items has the undesirable effect of uncovering the entire access opening of the temperature and/or humidity controlled storage compartment and exposing same to the ambient atmosphere. This repetitive opening to retrieve individual portions of foodstuffs or other products taxes the capacity of the refrigeration and/or warming equipment and is inefficient.

OBJECTS AND SUMMARY OF THE INVENTION

It is a principal object of the present invention to provide an improved environmentally controlled cabinet that can be used in a commercial setting to store foodstuffs or other items requiring a controlled environment.

It is also a principal object of the present invention to provide an improved temperature and/or humidity controlled cabinet that permits numerous individual portions of foodstuffs or other products to be constantly withdrawn from the environmentally controlled compartment without unduly taxing the refrigeration or warming equipment and without hindering the process of restocking the environmentally controlled compartment.

It is another principal object of the present invention to provide an improved environmentally controlled cabinet that minimizes heat gain and/or loss with respect to the environmentally controlled compartment of the cabinet during the numerous and frequent instances when individual portions of foodstuffs and/or other products are constantly withdrawn from the environmentally controlled compartment and without hindering the process of restocking the environmentally controlled compartment.

It is a further principal object of the present invention to provide an improved temperature and humidity controlled cabinet that minimizes humidity fluctuations in the environmentally controlled compartment of the cabinet during the numerous and frequent instances when individual portions of foodstuffs or other items are periodically withdrawn from the environmentally controlled compartment and without hindering the process of restocking the environmentally controlled compartment.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the temperature and/or humidity controlled cabinet of the present invention includes an environmentally controlled compartment having a main access opening and a swing door that is configured to selectively permit access to the inside of the environmentally controlled compartment via at least a portion of the main access opening and to close off access to the inside of the environmentally controlled compartment via at least a portion of the main access opening. The cabinet further includes at least one sliding door that is defined in a portion of the swing door and that is configured to selectively permit access to the inside of the environmentally controlled compartment and to close off access to the inside of the environmentally controlled compartment.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1A:
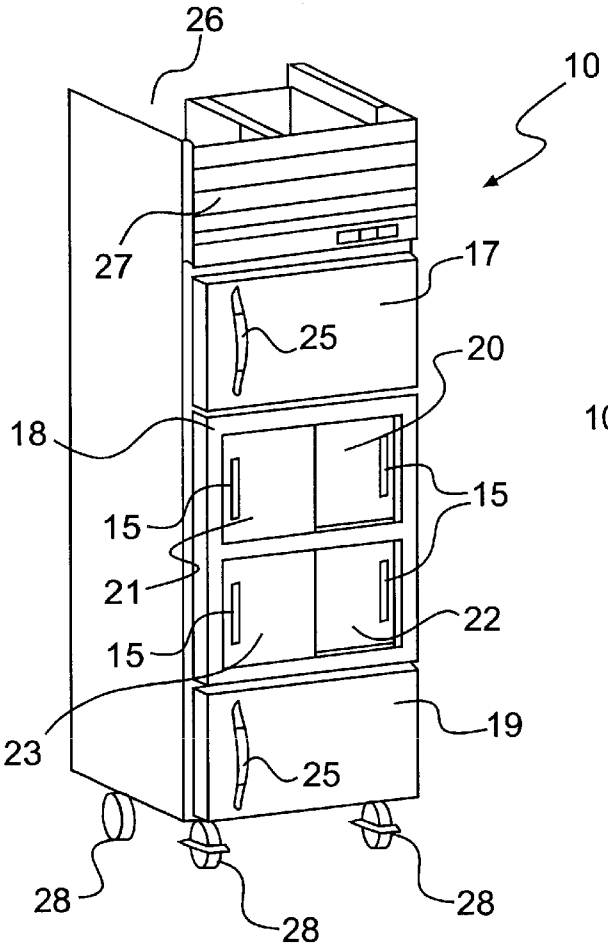
FIG. 1A is an elevated perspective view of a first preferred embodiment of the present invention.

Foodstuffs, medicines, and chemical reagents are some examples of items that must be stored where the temperature and/or humidity can be controlled. The present invention can be implemented in any apparatus or device that includes a confined space or compartment in which the environment, including at least the temperature and/or the humidity, is controlled relative to the immediate environment that exists outside of such space or compartment. Thus, examples of the environmentally controlled cabinet of the present invention would include a refrigerator, a freezer or a warming cabinet. A presently preferred embodiment of the environmentally controlled cabinet of the present invention is shown in FIG. 1A and is represented generally by the numeral 10. In the view shown in FIG. 1C, a side wall 12 of cabinet 10 is depicted as partly cut away to reveal the inside of an environmentally controlled compartment 14 that is defined within cabinet 10 and is configured for the storage of foodstuffs or anything else that needs to be kept at temperatures above or below the temperature of the immediate environment of the cabinet and/or at humidities above or below the humidity of the immediate environment.

Figure 1B:
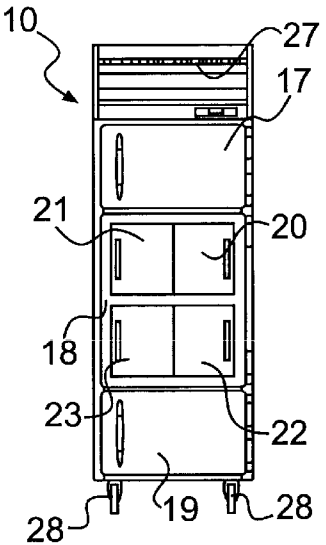
FIG. 1B is a front plan view of the embodiment of FIG. 1A.
Figure 1C:
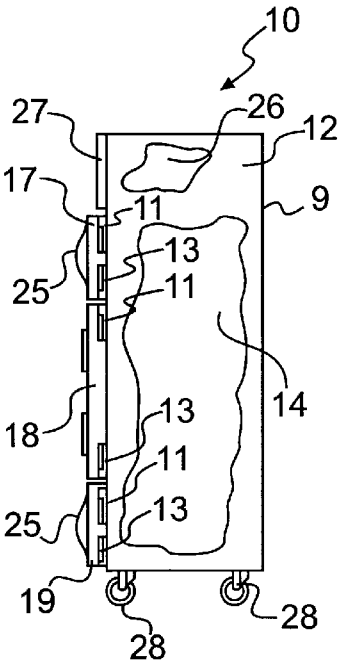
FIG. 1C is a side plan view with portions cut away of the embodiment of FIGS. 1A an 1B.

Though not shown in the cut away view in FIG. 1C for the sake of convenience, numerous internal configurations of compartment 14 are contemplated. These configurations would include for example a plurality of flat, horizontally extending shelves that subdivide the inside of environmentally controlled compartment 14 to coincide with the location of the doors described below. Alternatively, such shelves could be oriented to be angled from the rear wall 9 (FIG. 1C) of the cabinet 10 toward the main access opening 16 to facilitate user access to the inside of the environmentally controlled compartment 14. Another contemplated configuration for environmentally controlled compartment 14 would include a plurality of heat insulating walls that subdivide the inside of environmentally controlled compartment 14 into two or more individual and separate subcompartments that may (or may not) coincide with the location of the doors described below, but also may be maintained at separate temperatures and/or humidity levels from one another.

Figure 1D:
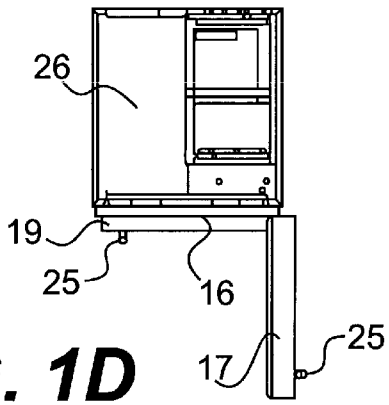
FIG. 1D is a top plan view of the embodiments of FIGS. 1A, 1B and 1C.

As shown in FIG. 1D, a main access opening 16 is provided through the front of cabinet 10 to the inside of the environmentally controlled compartment 14 indicated in FIG. 1C. As shown in FIGS. 1A, 1B and 1C, at least one swing door 18 is configured to selectively permit access to the inside of the environmentally controlled compartment 14 via at least a portion of the main access opening 16 and to close off access to the inside of the environmentally controlled compartment 14 via at least a portion of the main access opening 16. In the embodiment of FIGS. 1A, 1B, 1C and 1D, swing door 18 covers about one-half of the area of main access opening 16. As shown in FIG. 1C, middle swing door 18 is pivotally connected to the front wall of cabinet 10 via an upper hinge 11 and a lower hinge 13. However, middle swing door 18 also could be hinged on the left side of cabinet 10, as desired. Alternatively, middle swing door 18 also could be hinged at the top or the bottom of door 18. In each way, swing door 18 can be pivoted on its hinges 11, 13 so as to be selectively opened or closed to permit access or to deny access, respectively, to the inside of the environmentally controlled compartment 14.

As shown in FIGS. 1A and 1B, at least one sliding door 20 is defined in a portion of the swing door 18. The sliding door 20 is configured to selectively permit access to the inside of the environmentally controlled compartment 14 and to close off access to the inside of the environmentally controlled compartment. As shown in FIGS. 1A and 1B, sliding door 20 is disposed adjacent a sliding door 21, and the two doors form a side-by-side pair of sliding doors configured to cover approximately the upper half of the area covered by swing door 18. A second pair of side-by-side sliding doors 22, 23 is configured to cover the area of approximately the lower half of swing door 18. One or more of sliding doors 20, 21, 22, 23 can be slidingly mounted top and bottom on tracks. Alternatively, one or more of sliding doors 20, 21, 22, 23 can be slidingly mounted on tracks only at the top or only at the bottom. Any one of the sliding doors 20, 21, 22 and 23 can be used to expose to the ambient atmosphere into compartment 14, a much smaller opening than would occur if the swing door 18 were opened.

As desired, cabinet 10 can be configured so that the environmentally controlled compartment 14 remains unlighted regardless whether one or more of the sliding doors 20, 21, 22, and 23, or hinged doors 17, 18, 19 is oriented in the position that closes or permits access to the inside of temperature and/or humidity controlled compartment 14. Alternatively, cabinet 10 can be configured so that one or more sections of the environmentally controlled compartment 14 becomes at least partially lighted, if not fully lighted, as one or more of the sliding doors 20, 21, 22, and 23 is moved from the closed position shown in FIG. 1A to the open position (not shown) that permits access to the inside of the environmentally controlled compartment 14. Moreover, in this alternative configuration, the lighting of one or more sections of the environmentally controlled compartment 14 can be extinguished as one or more of the sliding doors 20, 21, 22, and 23, is moved from the open position (not shown) that permits access to the inside of the environmentally controlled compartment 14 to the closed position shown in FIG. 1A. Furthermore, the same lighting configurations described above in relation to the sliding doors 20, 21, 22, and 23, can be applied to the hinged doors 17, 18 and 19 as well.

As shown in FIG. 1A for example, each sliding door 20, 21, 22, 23, can include a handle 15. Alternatively, a groove or recess 15 can be provided in each sliding door 20, 21, 22, 23 at the same or another location as handle 15 in order to provide a means for the user to grab the sliding door and slide same to open and close the sliding door. The handle on sliding door 21 or on sliding door 23 also can be used to open and close swing door 18.

As shown in FIGS. 1A, 1B and 1C, swing door 18 is disposed between a pair of pivotally mounted swing doors 17 and 19, which each cover about one quarter of the area of main access opening 16. Each swing door 17, 19 can be pivoted on its hinges 11, 13 so as to be selectively opened or closed to permit access or to deny access, respectively, to the inside of the environmentally controlled compartment 14. As shown in FIG. 1A for example, a handle 25 can be provided (or not as desired) to assist the user in opening upper swing door 17, and a similar handle 25 can be provided (or not as desired) to assist the user to open lower swing door 19.

As shown in FIGS. 1A, 1C and 1D, an equipment compartment 26 is disposed in cabinet 10 above environmentally controlled compartment 14 and can be provided with a front louver grill 27 (FIGS. 1A and 1B) to permit air to be exchanged between equipment compartment 26 and the ambient atmosphere. Though not shown, equipment compartment 26 can be configured beneath environmentally controlled compartment 14 or split into one equipment compartment section disposed above and one disposed beneath environmentally controlled compartment 14.

Equipment compartment 26 can be configured to house conventional refrigeration equipment such as a compressor, a thermostat, a condenser, an evaporator, and a fan. In a split equipment compartment 26, the condenser could be disposed in the section located beneath the environmentally controlled compartment 14, while the evaporator is disposed in the section located above compartment 14. Alternatively, the condenser could be located remotely from the cabinet 10. The refrigeration equipment can be configured in a conventional forced air refrigeration system. However, a cold wall refrigeration system also can be provided in an alternative embodiment. Moreover, the refrigeration equipment can be configured for operation in any low temperature application, whether above or below the freezing temperature of water.

Equipment compartment 26 can be configured to house conventional warming equipment such as a thermostat and an electric heater for example. Equipment compartment 26 can be configured to house conventional equipment for regulating the humidity levels inside compartment 14.

As shown in FIGS. 1A, 1B, and 1C, cabinet 10 can be rendered mobile by means of castors 28. However, wheels or a combination of wheels and castors also can be used to render cabinet 10 mobile, as desired. Alternatively, cabinet 10 need not be rendered mobile, and can be mounted on stationary legs or a mounting stand.

A cabinet 30 shown in FIGS. 2A, 2B, 2C and 2D, constitutes another preferred embodiment of the present invention. As indicated by the similar placement of the similar numerals, cabinet 30 differs from cabinet 10 primarily in the number of swing doors and the disposition of the sliding doors.

Figure 2A:
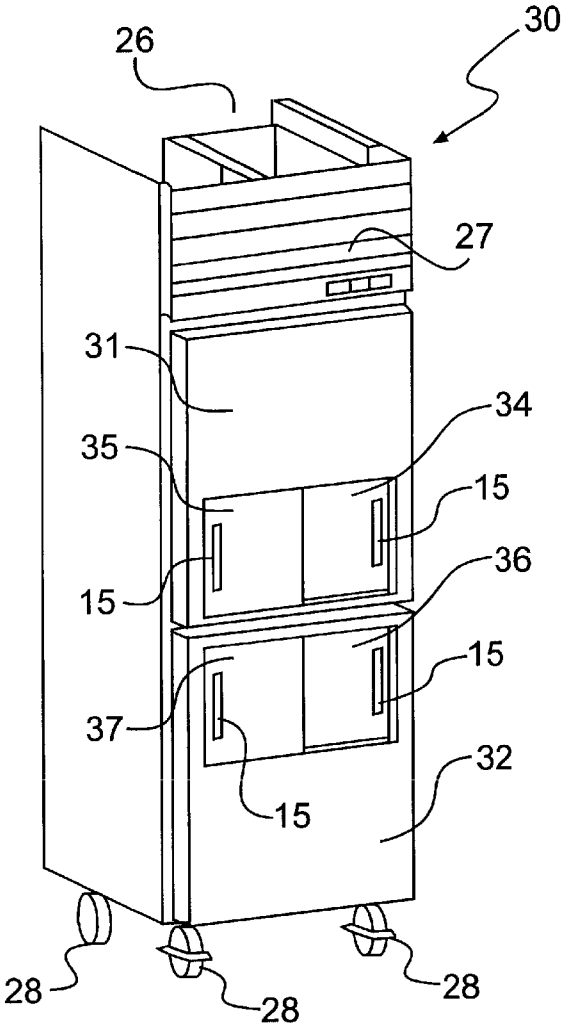
FIG. 2A is an elevated perspective view of a second preferred embodiment of the present invention.
Figure 2B:
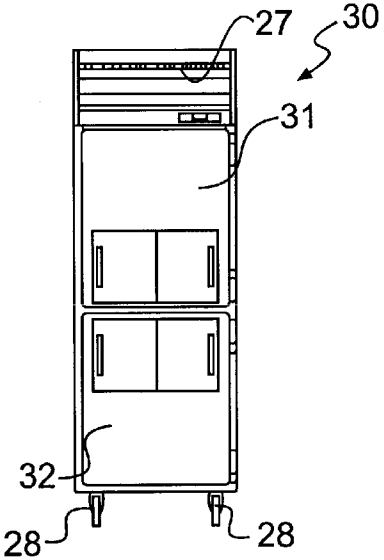
FIG. 2B is a front plan view of the embodiment of FIG. 2A.
Figure 2C:
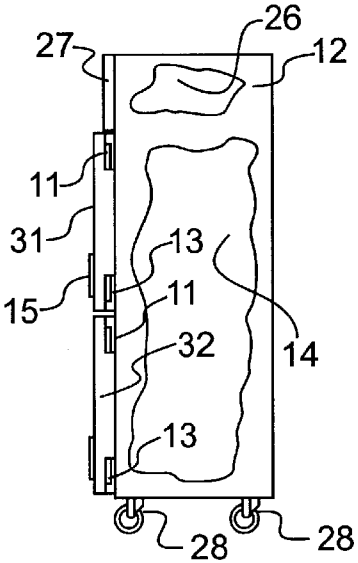
FIG. 2C is a side plan view with portions cut away of the embodiment of FIGS. 2A and 2B.
Figure 2D:
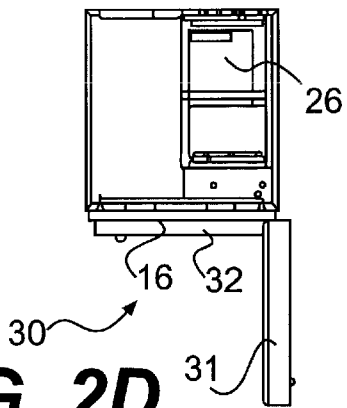
FIG. 2D is a top plan view of the embodiments of FIGS. 2A, 2B and 2C.

As shown in FIG. 2A, cabinet 30 includes an upper swing door 31 that is pivotally disposed to cover approximately the area of the upper half of main access opening 16. A lower swing door 32 is configured to cover approximately the area of the lower half of main access opening 16. A first sliding door 34 covers approximately one-half of the lower portion of the area of swing door 31. A second sliding door 35 is disposed adjacent to sliding door 34 and covers approximately the area of the remaining lower one-half of swing door 31. A third sliding door 36 covers approximately the area of one-half of the upper half of swing door 32. A fourth sliding door 37 covers approximately one-half of the area of the upper half of swing door 32 and is disposed adjacent to third sliding door 36. Sliding doors 34, 35, 36 and 37 can be provided with handles 15, but could be provided with vertically extending recesses 15 to permit the user to slide each sliding door to and fro to open and close access to main access opening 16. If provided, the handles 15 on doors 35 and 37 are configured so that they also can be used to open swing door 31 and 32, respectively.

As shown in FIGS. 3A, 3B, 3C and 3D, an environmentally controlled cabinet 40 constitutes a third preferred embodiment of the present invention. As indicated by the similar placement of the similar numerals, cabinet 40 differs from cabinet 10 primarily in the number, configuration and disposition of the sliding doors. Cabinet 40 is provided with an upper swing door 17 disposed above a middle swing door 41, which in turn is disposed above a lower swing door 19. Each of upper swing door 17 and lower swing door 19 are provided with a handle 25.

Figure 3D:
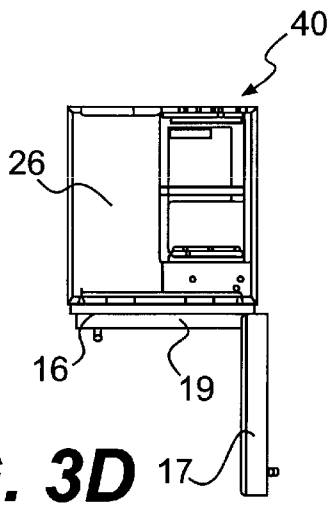
FIG. 3D is a top plan view of the embodiments of FIGS. 3A, 3B and 3C.
Figure 3C:
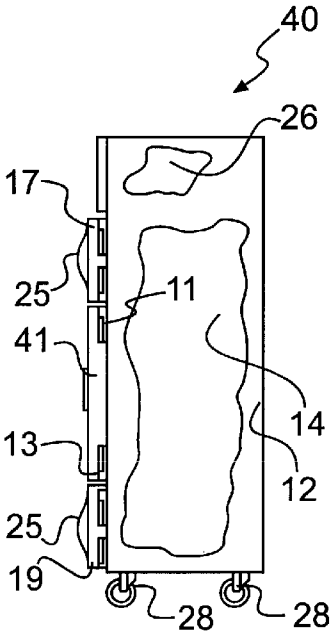
FIG. 3C is a side plan view with portions cut away of the embodiment of FIGS. 3A and 3B.
Figure 3B:
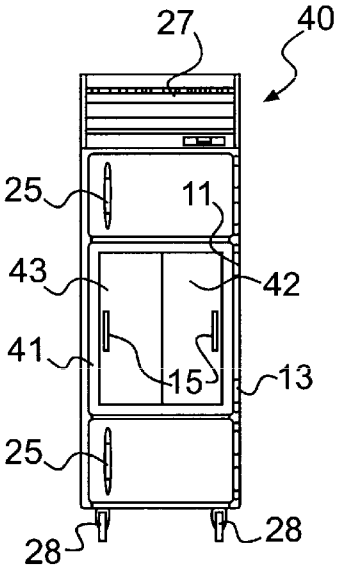
FIG. 3B is a front plan view of the embodiment of FIG. 3A.
Figure 3A:
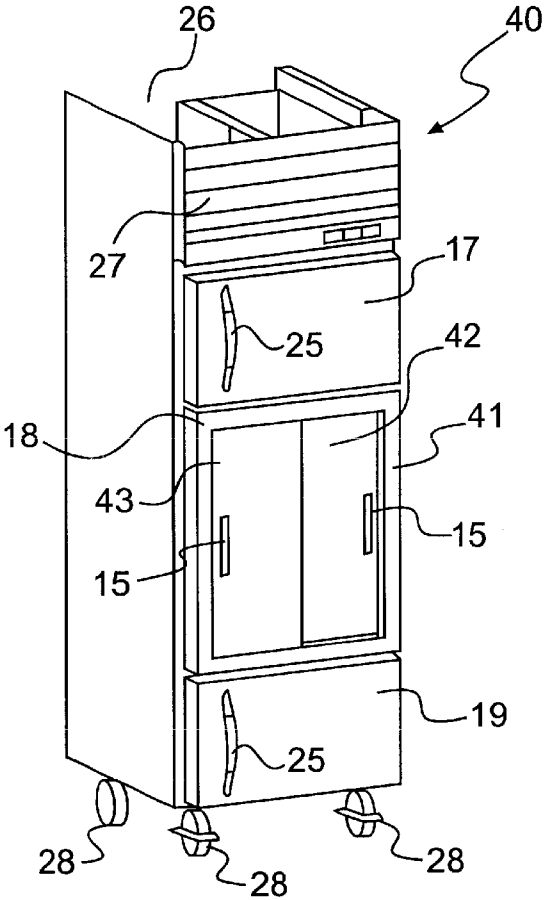
FIG. 3A is an elevated perspective view of a third preferred embodiment of the present invention.

As shown in FIGS. 3A and 3B for example, middle swing door 41 is sized to cover about one-half of the area of main access opening 16. Middle swing door 41 is configured to include a first sliding door 42 disposed alongside a second sliding door 43. Each of first sliding door 42 and second sliding door 43 is sized to cover about one-half of the area of middle swing door 41. A handle 15 can be provided for each of first sliding door 42 and second sliding door 43. Alternatively, each sliding door 42 and 43 can be provided with a recess 15 configured to assist the user in grasping each respective sliding door to slide same and thereby permit access to a reduced portion of the entire area of the main access opening 16 and thereby the inside of temperature controlled compartment 14. Cabinet 40 is otherwise constructed in the same manner as cabinet 10 shown in FIGS. 1A, 1B, 1C and 1D.

Figure 4A:
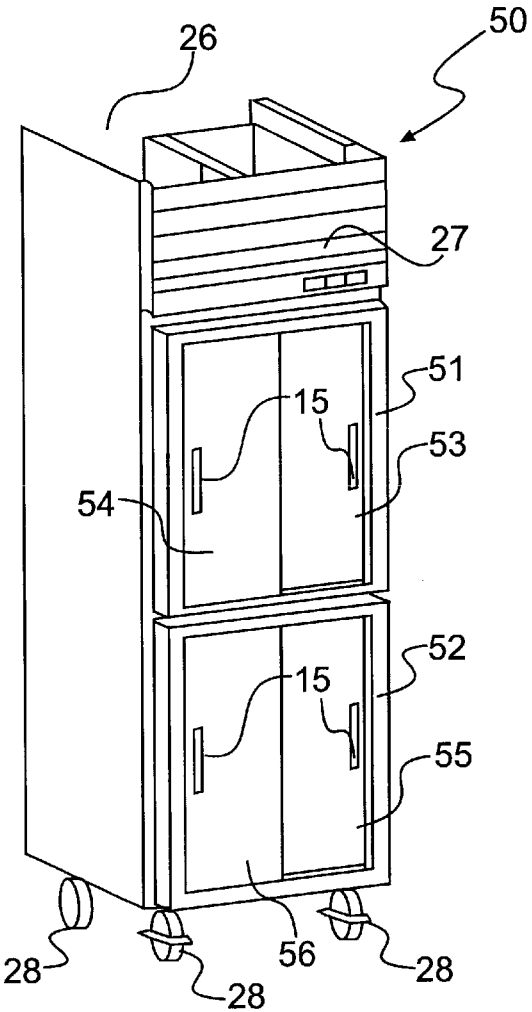
FIG. 4A is an elevated perspective view of a fourth preferred embodiment of the present invention.
Figure 4B:
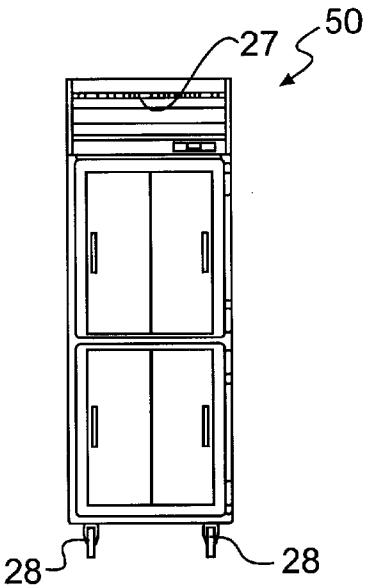
FIG. 4B is a front plan view of the embodiment of FIG. 4A.
Figure 4C:
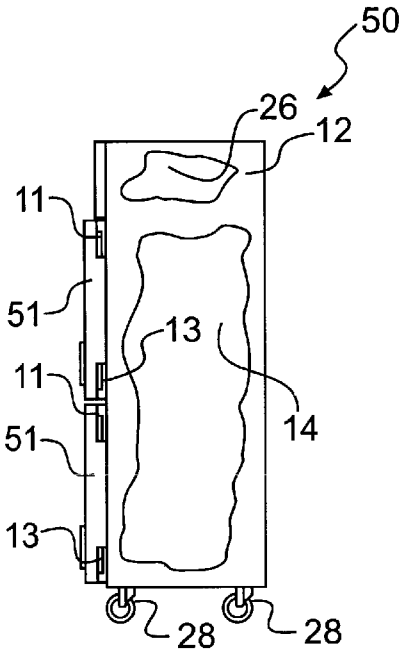
FIG. 4C is a side plan view with portions cut away of the embodiment of FIGS. 4A and 4B.
Figure 4D:
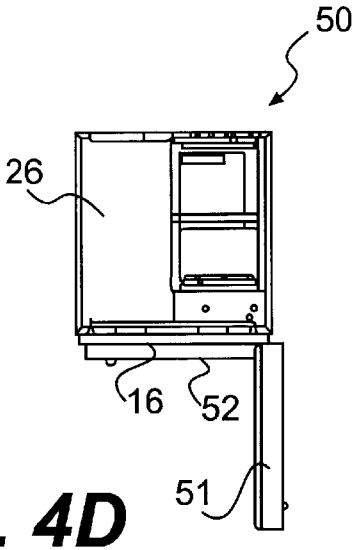
FIG. 4D is a top plan view of the embodiments of FIGS. 4A, 4B and 4C.

An environmentally controlled cabinet 50 shown in FIGS. 4A, 4B, 4C, and 4D constitutes a fourth preferred embodiment of the environmentally controlled cabinet of the present invention. As shown in FIGS. 4A and 4B for example, cabinet 50 is provided with an upper swing door 51 covering the area of approximately the upper one-half portion of main access opening 16. A lower swing door 52 covers the area of approximately the lower half of main access opening 16. A first sliding door 53 covers approximately one-half of the area of upper swing door 51. A second sliding door 54 is disposed adjacent first sliding door 53 and covers approximately the other half of the area of upper swing door 51. A third sliding door 55 covers approximately one-half of the area of lower swing door 52. A fourth sliding door 56 is disposed adjacent third sliding door 55 and covers approximately the remaining half of the area of lower swing door 52. Each sliding door 53, 54, 55 and 56 is provided with a handle 15. Alternatively, each sliding door 53, 54, 55 and 56 can be provided with a recess 15 that is configured to assist the user in grasping each respective sliding door to slide same and thereby permit access to a reduced portion of the entire area of the main access opening 16 and thereby the inside of environmentally controlled compartment 14. Cabinet 50 is otherwise similar in its configuration and components to cabinet 30 shown in FIGS. 2A, 2B, 2C and 2D.

While several preferred embodiments of the invention have been described using specific terms, each such description is for illustrative purposes only, and it is to be understood that changes and variations may be made without departing from the spirit or scope of the invention. For example, any of the types of sliding doors (or any combination of sliding doors) can be provided in a single swing door that covers the entire are of the main access opening 16. Additionally, four swing doors could be provided of essentially equal size to cover the area of the main access opening, and one or more of these four so-called "quarter" swing doors could be provided with a pair of sliding doors that covered essentially the entire area of each quarter swing door. Moreover, while single section cabinets have been illustrated, any of the door configurations (or any combination of the door configurations) can be provided on multi-section cabinets.

What is claimed is:

1. A cabinet, comprising:

a temperature controlled compartment having a main access opening;

a first swing door pivotally hinged to the cabinet and configured to selectively permit access to the inside of said compartment via at least a first portion of said main access opening and to close off access to the inside of said compartment via said first portion of said main access opening;

a first sliding door that is defined in a first portion of said swing door, said first sliding door being configured to selectively permit access to the inside of said compartment and to close off access to the inside of said compartment;

a second sliding door disposed adjacent said first sliding door, said first and second sliding doors forming a first side-by-side pair of sliding doors that is configured to cover approximately one half of the area covered by said first swing door; and a third sliding door that is defined in a second portion of said first swing door, said third sliding door being configured to selectively permit access to the inside of said compartment and to close off access to the inside of said compartment.

2. A cabinet as in claim 1, further comprising:

a fourth sliding door disposed adjacent said third sliding door, said third and fourth sliding doors forming a second side-by-side pair of sliding doors configured to cover approximately the lower half of the area covered by said first swing door.

3. A cabinet as in claim 1, further comprising:

a second swing door pivotally hinged to the cabinet and configured to selectively permit access to the inside of said compartment via at least a second portion of said main access opening and to close off access to the inside of said compartment via said second portion of said main access opening.

4. An environmentally controlled cabinet, comprising:

a temperature controlled compartment having a main access opening;

a first swing door pivotally hinged to the cabinet and configured to selectively permit access to the inside of said compartment via at least a first portion of said main access opening and to close off access to the inside of said compartment via said first portion of said main access opening;

a second swing door pivotally hinged to the cabinet and configured to selectively permit access to the inside of said compartment via at least a second portion of said main access opening and to close off access to the inside of said compartment via said second portion of said main access opening;

a third swing door pivotally hinged to the cabinet and configured to selectively permit access to the inside of said compartment via at least a third portion of said main access opening and to close off access to the inside of said compartment via said third portion of said main access opening; and a first sliding door that is defined in a first portion of one of said first, second or third swing doors, said first sliding door being configured to selectively permit access to the inside of said compartment and to close off access to the inside of said compartment.

5. A cabinet as in claim 4 wherein:

said second swing door is selectively configured to permit access to and close off access to an upper portion of said compartment;

said first swing door is selectively configured to permit access to and to close off access to a central portion of said compartment; and said third swing door is selectively configured to permit access to and to close off access to a lower portion of said compartment.

6. A cabinet as in claim 4 further comprising:

a second sliding door defined in said first portion of said one of said first, second or third swing doors, said second sliding door disposed adjacent said first sliding door.

* * * * *